US012031799B2

(12) United States Patent
Wohlstein et al.

(10) Patent No.: US 12,031,799 B2
(45) Date of Patent: Jul. 9, 2024

(54) SYSTEM AND METHOD FOR INCREASING PERFORMANCE OF SHOOTER AND FIREARM

(71) Applicant: Valen Foundry Inc., Dover, DE (US)

(72) Inventors: Scott Wohlstein, West Chester, OH (US); Fred Koeck, Stroudsburg, PA (US); Bruce Cole, Blytheville, AR (US); Doug Peebles, Dublin, OH (US); Richard Kloostra, Worthington, OH (US); Burn Rice, Edgewoodnm, NM (US); Larry Wright, Saint Paul, NM (US); William Rankin, Jr., Medina, OH (US)

(73) Assignee: Valen Foundry Inc., Dover, DE (US)

( * ) Notice: Subject to any disclaimer, the term of this patent is extended or adjusted under 35 U.S.C. 154(b) by 613 days.

(21) Appl. No.: 17/103,824

(22) Filed: Nov. 24, 2020

(65) Prior Publication Data

US 2021/0199407 A1 Jul. 1, 2021

Related U.S. Application Data

(60) Provisional application No. 62/954,873, filed on Dec. 30, 2019.

(51) Int. Cl.

| | |
|---|---|
| ***F41G 3/26*** | (2006.01) |
| ***F41A 19/11*** | (2006.01) |
| ***F41A 33/00*** | (2006.01) |
| *F41A 17/00* | (2006.01) |

(52) U.S. Cl.

CPC ..... *F41G 3/26* (2013.01); *F41A 19/11* (2013.01); *F41A 33/00* (2013.01); *F41A 17/00* (2013.01)

(58) Field of Classification Search

CPC ... F41G 3/26; F41G 3/30; F41A 19/11; F41A 33/00; F41A 17/00; F41A 19/09; F41A 19/08; F41A 23/16; F41A 31/00

USPC ..... 434/19

See application file for complete search history.

(56) References Cited

U.S. PATENT DOCUMENTS

| | | | | |
|---|---|---|---|---|
| 4,026,057 | A * | 5/1977 | Cady | F41A 23/16 42/94 |
| 5,070,636 | A | 12/1991 | Mueller | |
| 7,086,192 | B2 * | 8/2006 | Deros | F41B 5/1449 248/278.1 |
| 8,109,028 | B2 | 2/2012 | Roberts | |
| 8,668,496 | B2 | 3/2014 | Nolen | |

(Continued)

FOREIGN PATENT DOCUMENTS

| | | |
|---|---|---|
| CN | 201945248 | 12/2010 |
| DE | 8203181 | 2/1982 |

(Continued)

*Primary Examiner* — Robert P Bullington, Esq.
*Assistant Examiner* — Stephen Alvesteffer
(74) *Attorney, Agent, or Firm* — Jenei LLC

(57) ABSTRACT

A system and method for measuring, characterizing, and making recommendations for improving the performance of a shooter and one or more associated firearms. A data collection environment comprises an operator device and a server and data management module configured to receive and transmit one or more data sets over a network. A rig, which may be configured with sensors, may comprise a base assembly, a stock assembly, a grip/trigger assembly, a forend assembly a remote trigger assembly, and a safety lanyard assembly.

15 Claims, 20 Drawing Sheets

(56) References Cited

U.S. PATENT DOCUMENTS

| | | | | |
|---|---|---|---|---|
| 10,267,587 | B2 | 4/2019 | Hutson | |
| 10,302,396 | B1 | 5/2019 | Ray | |
| 2007/0068379 | A1 | 3/2007 | Sween | |
| 2010/0221685 | A1* | 9/2010 | Carter | F41A 33/00 434/19 |
| 2015/0226523 | A1 | 8/2015 | Batchvarov | |
| 2015/0308789 | A1 | 10/2015 | Pietro | |
| 2016/0069644 | A1* | 3/2016 | Bell | F41G 3/02 89/204 |
| 2017/0363390 | A1 | 12/2017 | Allgaier | |
| 2019/0101351 | A1 | 4/2019 | Amburgey | |
| 2019/0244536 | A1* | 8/2019 | Tan | F41J 5/00 |

FOREIGN PATENT DOCUMENTS

| | | |
|---|---|---|
| EP | 1580516 | 9/2005 |
| KR | 1018655535 | 12/2017 |
| WO | WO2016065259 | 4/2016 |

* cited by examiner

SYSTEM AND METHOD FOR INCREASING PERFORMANCE OF SHOOTER AND FIREARM

CROSS REFERENCE TO RELATED APPLICATIONS

This application claims the priority benefit of U.S. Provisional Patent Application No. 62/954,873, filed Dec. 30, 2019 and entitled "System and Method for Increasing Accuracy of Shooter and Firearm," the contents of which are incorporated herein by reference in their entirety.

BACKGROUND

The present disclosure provides for a system and method for measuring, characterizing, and making recommendations for improving the performance of a shooter (also referred to herein as an "operator") and one or more associated firearms. The present disclosure overcomes the limitations of the prior art by providing a complete environment, or ecosystem, by which hardware, software, and data analytics, which may be diagnostic, condition based, preventative, predictive, prescriptive, and cognitive in nature, work together to achieve this result. Improvements over the prior art specifically include, the modular nature of the hardware (which holds the firearm also referred to herein as the "rig"), the addition of sensor(s) suites to the rig and/or the operator, and the combination of the hardware, software, and data collection to create a complete ecosystem that can be used to characterize and validate manufacturers of firearms, firearm components/accessories/performance features, and ammunition, as well as firearm operators and their trainers/instructors and related operator performance and enhancement manufacturers.

The system and method disclosed herein are non-intrusive and do not require any modifications, additional accessories, or other special firearm for use as is required by the prior art. The system and method provide for a mechanism for holding the firearm the way a human would hold the firearm, eliminating the disadvantages of the prior art in which a firearm is simply strapped or clamped down without specificity and which affects operation. By collecting impartial and objective data from both the operator and the rig, the system and method provide for a means to eliminate human, firearm, ammunition, and accessory choice-based errors when firing a firearm.

SUMMARY OF THE INVENTION

The present disclosure provides for a system comprising an operator device configured to receive and transmit one or more data sets over a network and a server and data management module configured to receive and transmit one or more data sets over a network. The server and data management module further comprises a registration customer service submodule and a partner services submodule.

In another embodiment, the present disclosure provides for a system comprising a base assembly, a safety lanyard assembly, a grip/trigger assembly, a remote trigger assembly, a forend assembly, a stock assembly, a grip cradle subassembly, and a Picatinny-style mount. The base assembly further comprises a dog bone assembly, a longitudinal rail assembly, and a plurality of swivel leveling mounts affixed to a plate of the dog bone assembly.

The stock assembly is operably connected to the longitudinal rail assembly and comprises a stock cradle, a brace, a first extension tube and a second extension tube, a plate configured to couple the first and second extension tubes, and a link base configured to connect the brace with the first and second extension tubes.

A grip/trigger assembly is operably connected to the longitudinal rail assembly and further comprises an adjustable upright grip/trigger tower affixed to the longitudinal rail assembly via a corner brace, a trigger guard holding mechanism affixed to the adjustable upright grip/trigger tower, a trigger guard gripper affixed to the trigger guard holding mechanism, a grip cradle subassembly, and a trigger engagement mechanism, part of the remote trigger assembly, affixed to the longitudinal rail assembly, comprises a plurality of gears configured to engage a trigger when activated.

A forend assembly is operably connected to the longitudinal rail assembly and further comprises an adjustable upright forend tower affixed to the longitudinal rail assembly via a corner brace, and a forend clamp mechanism, which is affixed to the adjustable upright forend tower. A Picatinny-style mount maybe alternatively and operably connected to the adjustable upright forend tower instead of the forend clamp mechanism.

A remote trigger assembly comprises a trigger engagement subassembly operably connected to the longitudinal rail assembly and comprises a plurality of gears configured to engage a trigger when activated is operably connected to remote pistol grip assembly comprises a remote pistol grip, a trigger handle, a pin, and a spring, coupled to a holder and a cable where the cable is further affixed to the pin.

A safety lanyard assembly comprising a lanyard, a pin operably connected to the lanyard via a cable, and an anchor end, where the anchor end is operably coupled to the longitudinal rail assembly. The pin is inserted into the remote pistol grip to prevent unintended operation when not ready to fire the firearm.

The system and method disclosed herein are configured for use by consumers (for recreational, competition, and long-range/high accuracy), manufacturers (for R&D/D, test, and QA/QC), and/or for use by first responders, law-enforcement, and the military. The system and method are designed to be compatible with all manufactured firearms and for use by operators with a wide variety of skill level and experience.

BRIEF DESCRIPTION OF THE DRAWINGS

The accompanying drawings, which are included to provide further understanding of the disclosure and are incorporated in and constitute a part of this specification illustrate embodiments of the disclosure, and together with the description, serve to explain the principles of the disclosure.

In the drawings.

DETAILED DESCRIPTION

Figure 1:
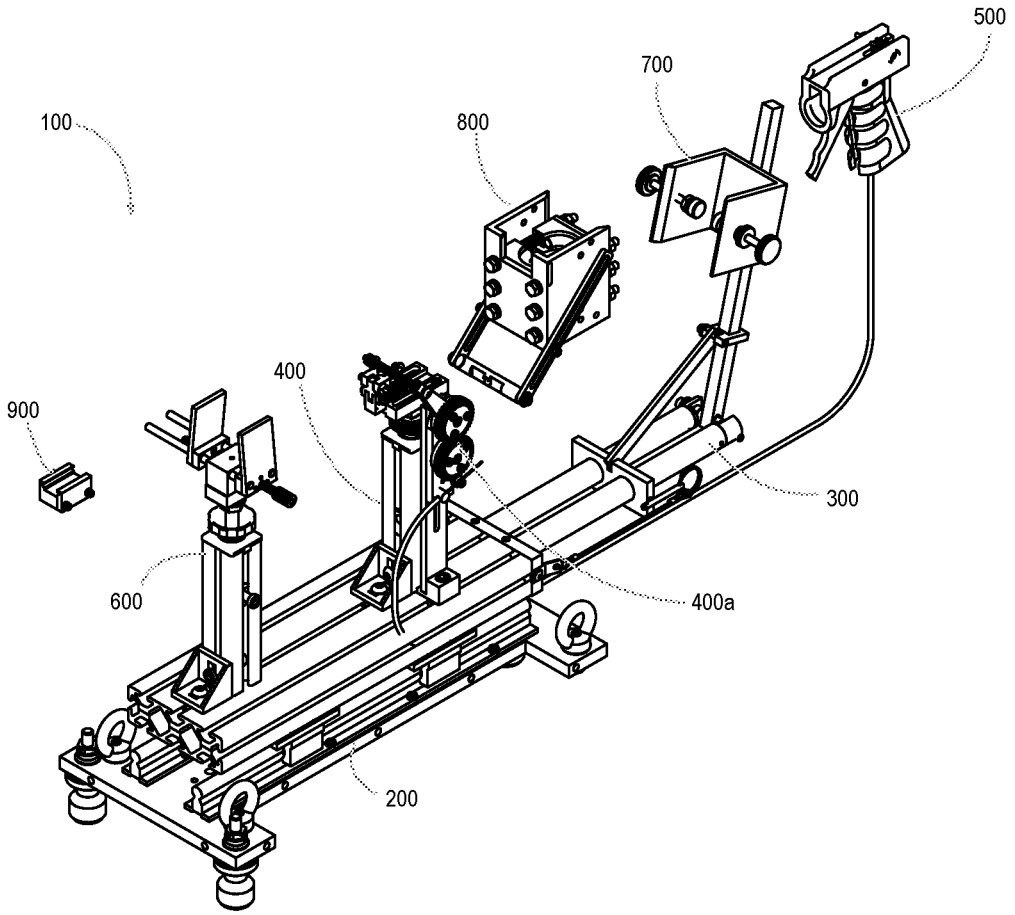
FIG. 1 is illustrative of a system of the present disclosure.

Reference will now be made in detail to the embodiments of the present disclosure, examples of which are illustrated in the accompanying drawings. Wherever possible, the same reference numbers will be used throughout the specification to refer to the same or like parts.

The present disclosure provides for a complete ecosystem, comprising software, hardware, and intelligence gathering in the form of data from a rig and/or operator. Each component of the ecosystem provides advantages over the prior art not only as part of the ecosystem as a whole, but also as individual elements. The ecosystem: (1) creates a user community and provides opportunities for receiving relevant content (such as advertising, retailer links, and other valuable content); (2) provides opportunities for engaging with other users (i.e., forum, contests and game); (3) provides opportunities for engaging with instructors and trainers; (4) provides opportunities for advertisers to reach these users with targeted messages or sponsorship; and (5) provides opportunities for manufacturers of firearms, firearm components/accessories/performance features, and ammunition as well as operator accessories and performance features to share data. Any/all these opportunities may be gained locally or at a remote location/distance.

The present disclosure provides for a system and method for measuring and characterizing the performance of a shooter, with and/or without accessories and/or performance features, and one or more associated firearms, with and/or without accessories and/or performance features, and making recommendations for improving the performance of each. Software may enable the connection between hardware (the rig) and operator via one or more sensor(s) suites to enable data gathering from the rig and/or operator and feedback (via direct or indirect means) to be provided regarding each and/or both. In one embodiment, the sensor (s) suite may comprise use of a LASER for alignment and LIDAR for displacement measurements among the other sensors within the sensor suite, and combinations thereof.

For example, the software may enable one or more data sets to be collected from the rig and/or the operator and processing this data to determine a target position for the rig and/or the operator. The software may also enable additional data sets to be collected each time the operator uses the rig or firearm or steps in to position to shoot. Such software may process the data collected from the various sensor(s) suites and compare the data with the target position saved for the rig and/or operator. This comparison may generate a number of different notifications to the user such as: (1) how far off their current rig and/or operator position is from the target position; and (2) what adjustments should be made correct their stance, firearm alignment, and/or body alignment so that the rig and operator are in the target position. Once an operator has fired the firearm, the software may enable the collection of post-firing data such as accuracy to target, providing immediate feedback on performance to enable the operator to make the necessary adjustments, as well as firearm and accessory information such as performance and predictive/preventative service and maintenance.

The present disclosure provides for an improved rig design that is configured so as to hold a firearm in place at the same points as an operator while returning the firearm to an original resting start position that is practically impossible for a human to accomplish after each cycle of operations of the firearm. Such positioning enables the most realistic and accurate data matching in terms of performance and can be used to generate data related to firearm performance managing predicted maintenance and service and preventing firearm failure. Due to the flexibility and modular nature of the rig design, it can be easily manipulated to hold a wide variety of different types of firearms and provides for uncorrupted operation of the firearm including ammunition and magazine changes. The design allows the firearm to operate as designed with translation and recoil mitigation. In one embodiment, the hardware is also configured with a variable recoil system that matches the platform while considering a "return to battery" and human retention and response. Unlike systems of the prior art, the present rig design does not rely on a mounted optic element as the centroid element.

It is also contemplated that the system of the present disclosure can be used in an indoor or an outdoor environment and can be used with a single user or configured with interconnectivity so that multiple users can interact while using the system, such as for competition or gaming.

The design also enables magazine changes without removing the firearm and does not touch the barrel but allows any/all barrels to float freely. In one embodiment, actual recoil may be measured by determining the mass of the firearm by first measuring the entire mass of the rig with the firearm in-place, then subtracting/taring the constant or known weight of the rig and applying F=MA to the displacement and accelerometric data and physically measuring the actual recoil compared with the data obtained through the sensor(s) suite in the stock cradle assembly used to determine felt recoil.

The combination of software and hardware enables robust intelligence gathering to support a complete ecosystem including firearms platforms (and their manufacturers of firearms, firearm components/accessories/performance features, and ammunition), as well as their operators and other individuals. Such an ecosystem may support targeted marketing campaigns by retailers, virtual competitions between rigs, and/or operators, and valuable operability information to manufacturers regarding the firearms, accessories, and components they manufacturer. Examples of data that may be generated include, but are not limited to:

Matching the best ammunition for a particular firearm.

Enabling efficient and effective recalls for firearms and accessories based on firearm platform and operator performance data.

Setting alerts and notifications for predictive maintenance for firearm and accessories.

Setting alerts and notifications for operational reminders.

Allowing data to be collected and assessed across multiple users.

Enabling baselines to be established for firearms and operators.

Measure shooting accuracy, distance between shots, distance to target, and other measurable results to enable users to make improvements and permit competition among various users.

Correlate data of the operator to various demographic data sets.

Setting alerts and notifications for scheduling shooting reminders to maintain consistent practice schedule in order to retain performance improvements.

Provide sanitized demographic and geographic intelligence to advertisers.

Assisting the manufacturers of firearms, firearm components/accessories/performance features, and ammunition, to produce the best product match to market.

Referring now to the drawings, FIG. 1 is illustrative of a system of the present disclosure. The system 100 comprises a plurality of assemblies and subassemblies which are operably connected to enable operation of the system 100. These assembles and subassemblies include a base assembly 200, a safety lanyard assembly 300, a grip/trigger assembly 400, a remote pistol grip assembly 500, a forend assembly 600, a stock cradle assembly 700, a grip cradle subassembly 800, and a Picatinny-style mount 900. Each of the foregoing assemblies and subassemblies are described in more detail below.

Figure 2A:
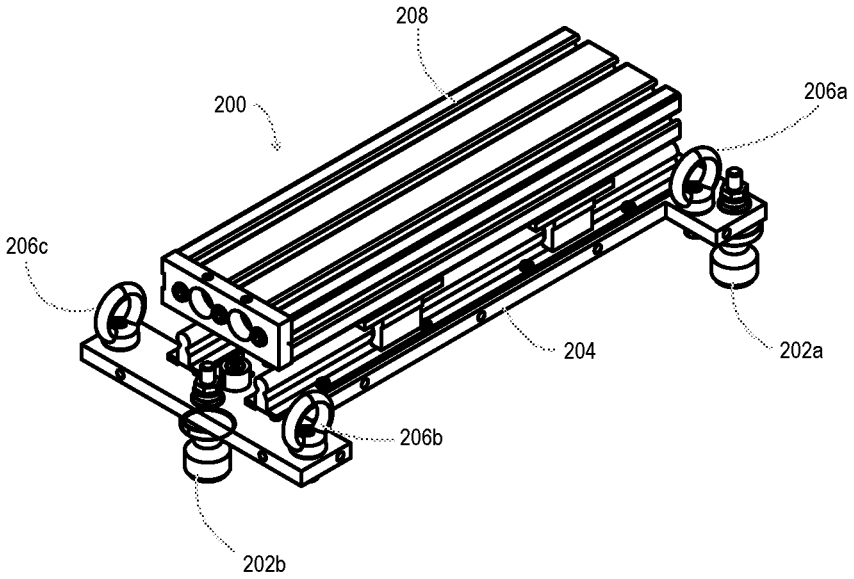
FIG. 2A is illustrative of a base assembly of a system of the present disclosure.
Figure 2B:
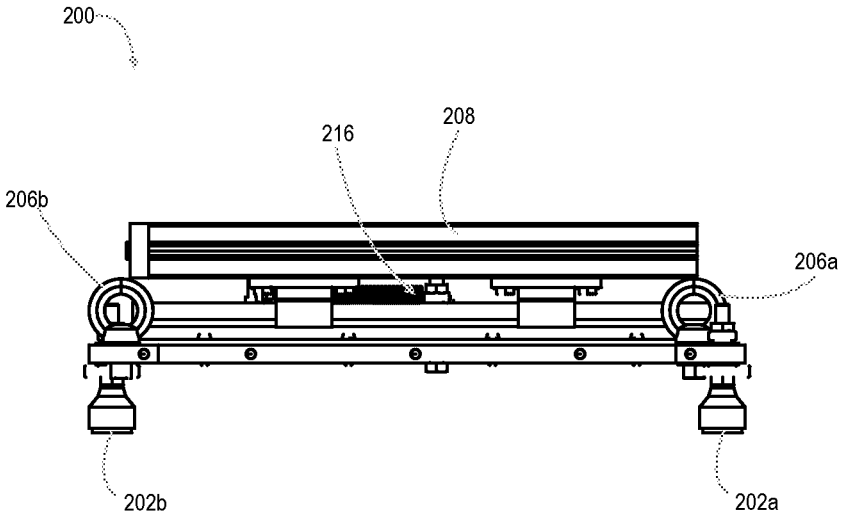
FIG. 2B is illustrative of a base assembly of a system of the present disclosure.
Figure 2C:
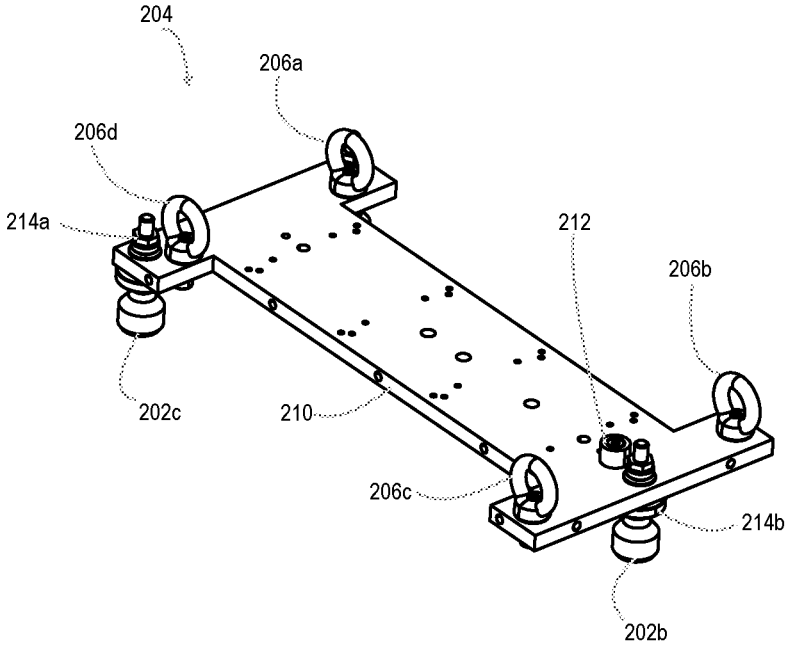
FIG. 2C is illustrative of a dog bone assembly of a system of the present disclosure.

The base assembly 200 is illustrated in detail in FIGS. 2A-2C. As seen in the figures, the base assembly comprises a plurality of swivel leveling mounts 202*a*, 202*b*, and 202*c* which serve as a foundation for the system 100 and also provide for an adjusting mechanism that can be used to adjust the overall height of the system 100 or to adjust the height of one part of the system 100 to account or uneven terrain. The swivel leveling mounts 202*a*, 202*b*, and 202*c* are each affixed to a plate 210 of a dog bone assembly 204. The dog bone assembly is illustrated in FIG. 2C. A plurality of eye nuts 206*a*, 206*b*, 206*c*, and 206*d* are also affixed to the plate 210 of the dog bone assembly 204. The dog bone assembly 204 is operably coupled to a longitudinal rail assembly 208. The plate 210 also comprises a bull's eye level and Philips head machine screw assembly 212 and a plurality of knurled knob assemblies 214*a* and 214*b* which are used to affix each of the swivel leveling mounts to the plate 210. A recoil spring 216 is further affixed to the longitudinal rail assembly 208 and to the dog bone assembly 204 to allow the linear translation of the longitudinal rail assembly 208 and to return it to rest under (adjustable for a wide range of recoil pressure) spring tension.

Figure 3:
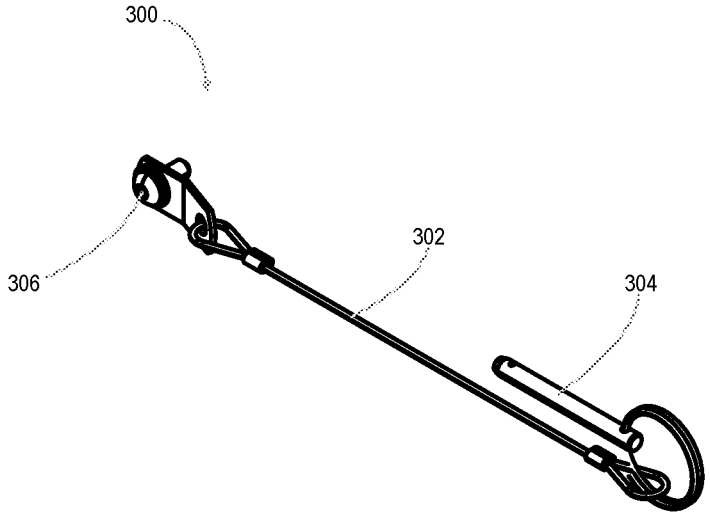
FIG. 3 is illustrative of a safety lanyard assembly of a system of the present disclosure.

The system further comprises a safety lanyard assembly 300 which is illustrated in FIG. 3. The safety lanyard assembly 300 comprises a lanyard 302 with a pin 304 and an anchor end 306, where the anchor end is configured to be operably coupled to the longitudinal rail assembly 208 using plurality of washers and button head cap screw. The pin 304 is operably coupled to the remote pistol grip subassembly 502 to prevent unintended operation.

Figure 4A:
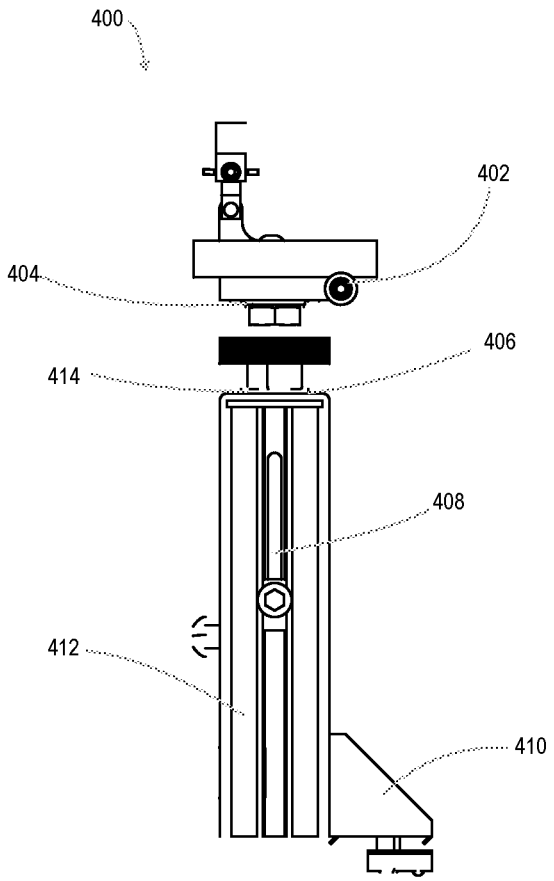
FIG. 4A is illustrative of a grip/trigger assembly of a system of the present disclosure.
Figure 4B:
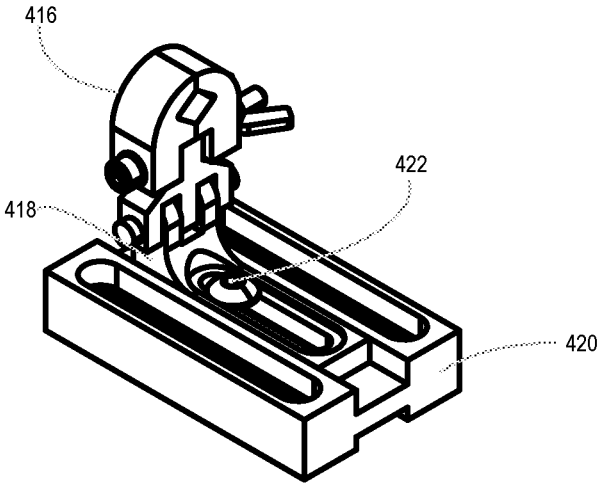
FIG. 4B is illustrative of a trigger guard gripper of a system of the present disclosure.
Figure 4C:
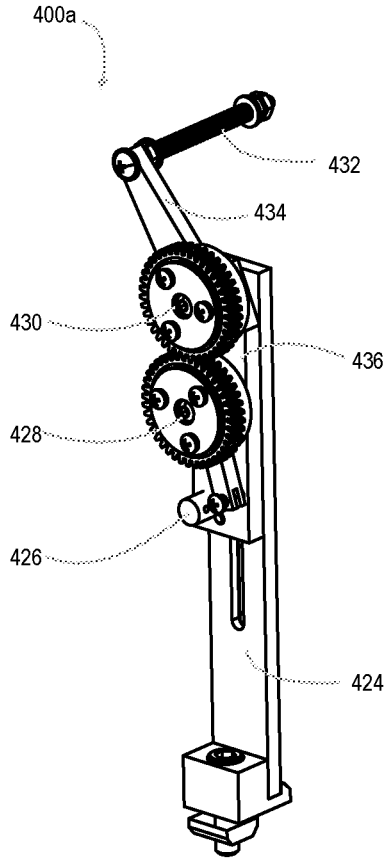
FIG. 4C is illustrative of trigger engagement subassembly of a system of the present disclosure.

The system 100 further comprises a grip/trigger assembly 400 which is operably connected to the longitudinal rail assembly 208 of base assembly 200. The grip/trigger assembly is illustrated by FIGS. 4A-4C and comprises an upright grip/trigger tower 412 is affixed to the longitudinal rail assembly 208 of base assembly 200 via a corner brace 410 and may be adjusted via a plurality oft nuts and bolts 408 to achieve the desired height of the grip/trigger assembly 400. The upright grip/trigger tower 412 is affixed to a trigger guard holding mechanism 402 using an adjusting rod 404, end cap 406 and washer 414. The grip/trigger assembly 400 further comprises a trigger guard gripper 416 connected to a block 420 using a brace 418 and a button head cap screw 422.

The trigger pull assembly 400A illustrated by FIG. 4C further comprises a trigger engagement mechanism 434 affixed to a spring 432. A plurality of gears, comprising a top gear 430 and a bottom gear 428 are operably connected and configured so as to enable the trigger engagement mechanism 434 to engage when activated. The plurality of gears 430 and 428 are affixed to a plate 436 which is used as a mount for the plurality of gears 430. A holder cable 426 may be used to affix the plurality of gears 430 and 428 to the plate 436 and the plate 436 may be further affixed to an upright member 424. This upright member 424 may be further affixed to the grip/trigger assembly 400 and to the longitudinal rail assembly 208 of base assembly 200.

Figure 5A:
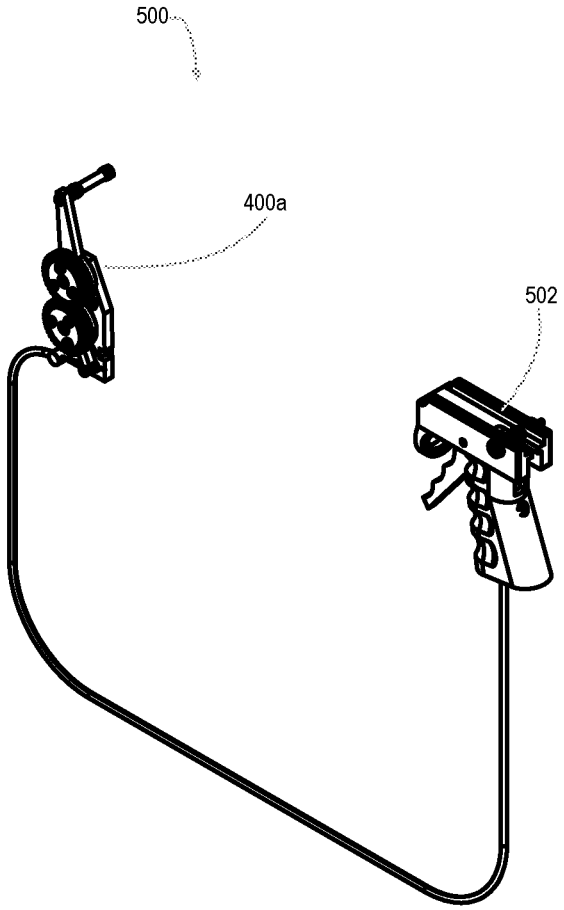
FIG. 5A is illustrative of a remote trigger assembly of a system of the present disclosure.
Figure 5B:
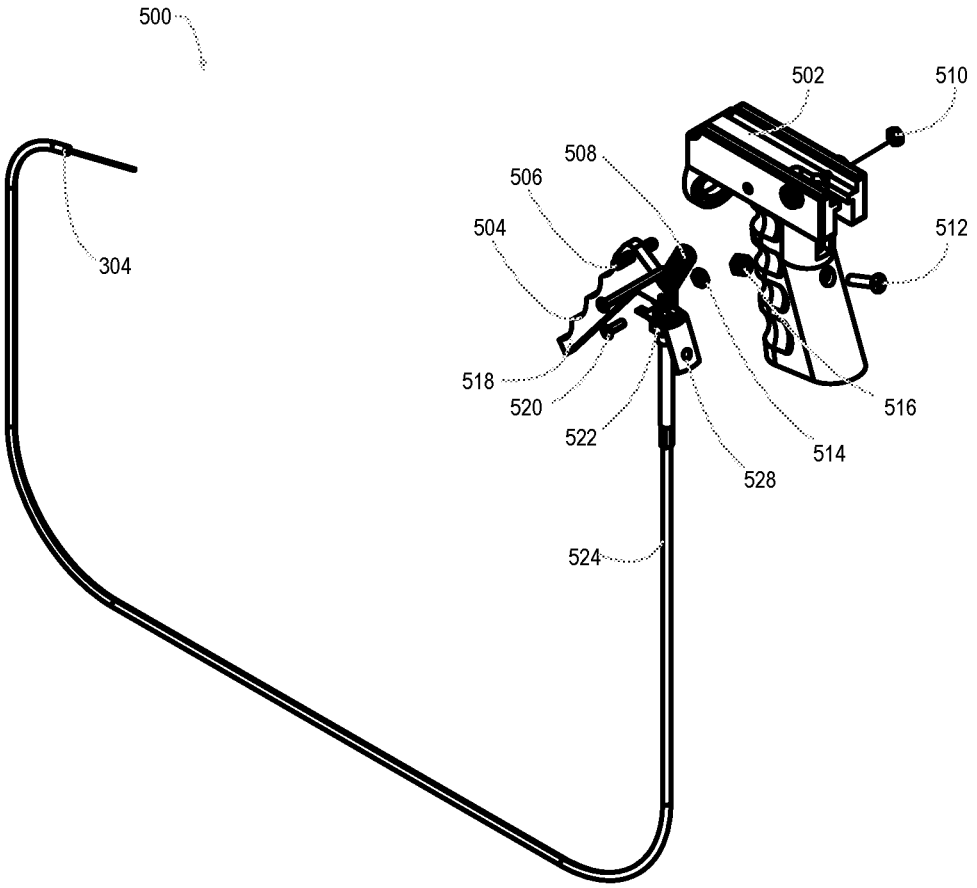
FIG. 5B is illustrative of a remote pistol grip assembly of a system of the present disclosure.

The system 100 further comprises a remote pistol grip assembly 500 which is illustrated in FIGS. 5A-5B. The remote pistol grip assembly 500 is configured to enable remote operation of the system 100 and firing of a firearm. The remote pistol grip assembly comprises a remote pistol grip 502 and a trigger handle 504. A pin 506 allows trigger handle 504 to pivot. A spring 508 is coupled to a holder 526 and cable 524, where the cable 524 is further affixed to pin 304. A plurality of screws 518, 520, 510, 512, and 516 are used to secure the elements of the remote pistol grip assembly.

Figure 6:
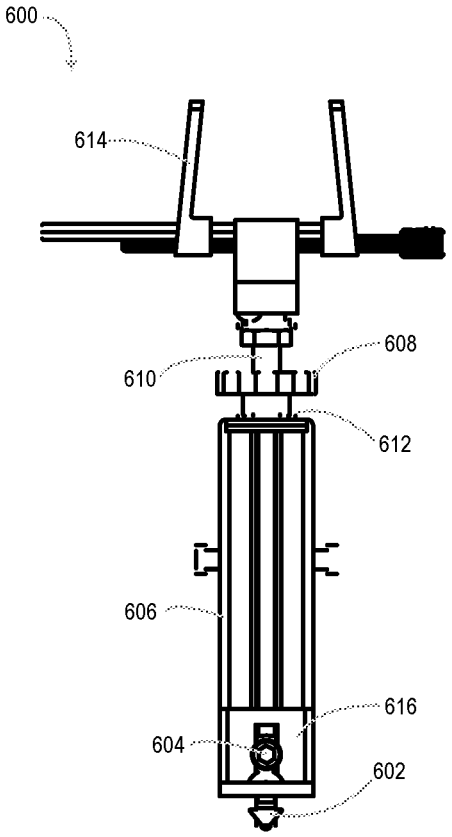
FIG. 6 is illustrative of a forend assembly of a system of the present disclosure.

Referring now to FIG. 6, the system 100 further comprises a forend assembly 600 which is operably connected to the longitudinal rail assembly 208 of base assembly 200. The forend assembly 600 comprises a corner brace 616 affixed to an upright forend tower 606 using a plurality oft nuts 602 and 604 and socket head cap screws. The upright forend tower 606 is operably connected to a forend cradle clamp mechanism 614 using an adjusting rod 610, washer 612, and end cap 608. The forend cradle clamp mechanism 614 may be adjusted as necessary to accommodate a wide variety of different firearms.

Figure 7:
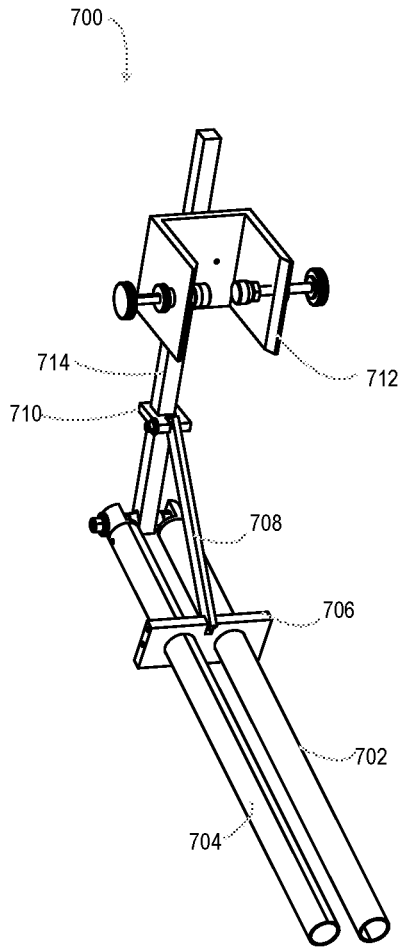
FIG. 7 is illustrative of a stock cradle assembly of a system of the present disclosure.

The system 100 further comprises a stock assembly 700, illustrated by FIG. 7, which is operably connected to the longitudinal rail assembly 208 of base assembly 200. The stock cradle assembly 700 comprises a first extension tube 702 and a second extension tube 704 coupled using a plate 706 and link base 708 to a brace 714 via lock assembly 710. A stock cradle 712 is affixed to the brace 714 using a mounting mechanism. The stock cradle may comprise one or more swivel pads and thumb screws that can be adjusted to accommodate a wide variety of different firearm stocks. In one embodiment a Rosetta joint may be used to affix the brace 714 to the first and second extension tubes 702 and 704 respectively, to provide a means for further adjusting the stock cradle assembly in detent/positive-locking and rotational positions to accommodate a wide variety of different firearm stocks.

Figure 8:
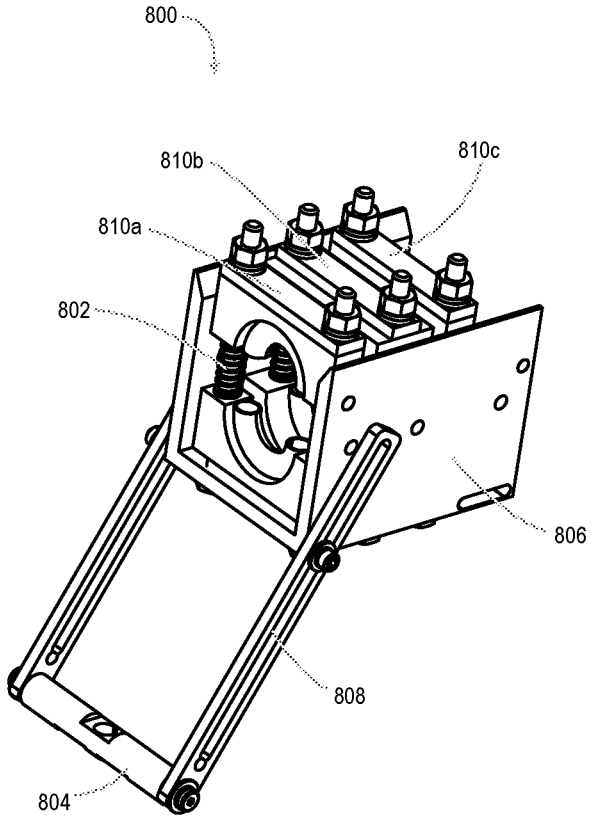
FIG. 8 is illustrative of a grip cradle assembly of a system of the present disclosure.
Figure 9:
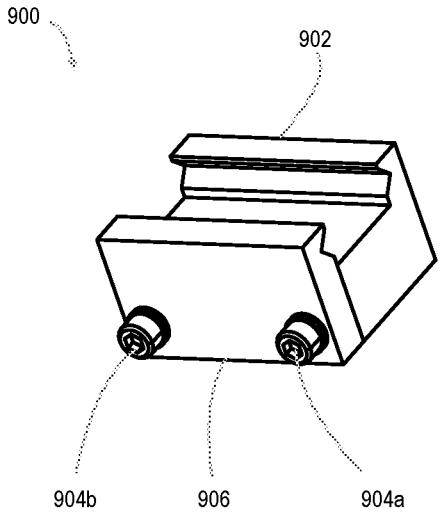
FIG. 9 is illustrative of a Picatinny-style mount of a system of the present disclosure.

FIG. 8 is illustrative of a grip cradle subassembly 800 which is operably connected to the adjustable upright grip/trigger tower 412. The grip cradle subassembly 800 further comprises a support axle 804 connected to two side supports 808. Each side support 808 is affixed to a grip cradle 806 which is configured to house a plurality of clamps 810*a*, 810*b*, and 810*c* to conform to and accommodate a wide variety of firearm grips. Each clamp further comprises one or more springs 802. FIG. 9 is illustrative of a Picatinny-style mount 900 comprising block 902 affixed to a locking plate 906. The locking plate is affixed to the block 902 using a plurality of washers and screws 904*a* and 904*b*. This mount can be affixed to adjustable upright forend tower 606 and used alternatively in place of/instead of forend cradle clamp mechanism 614.

Figure 10:
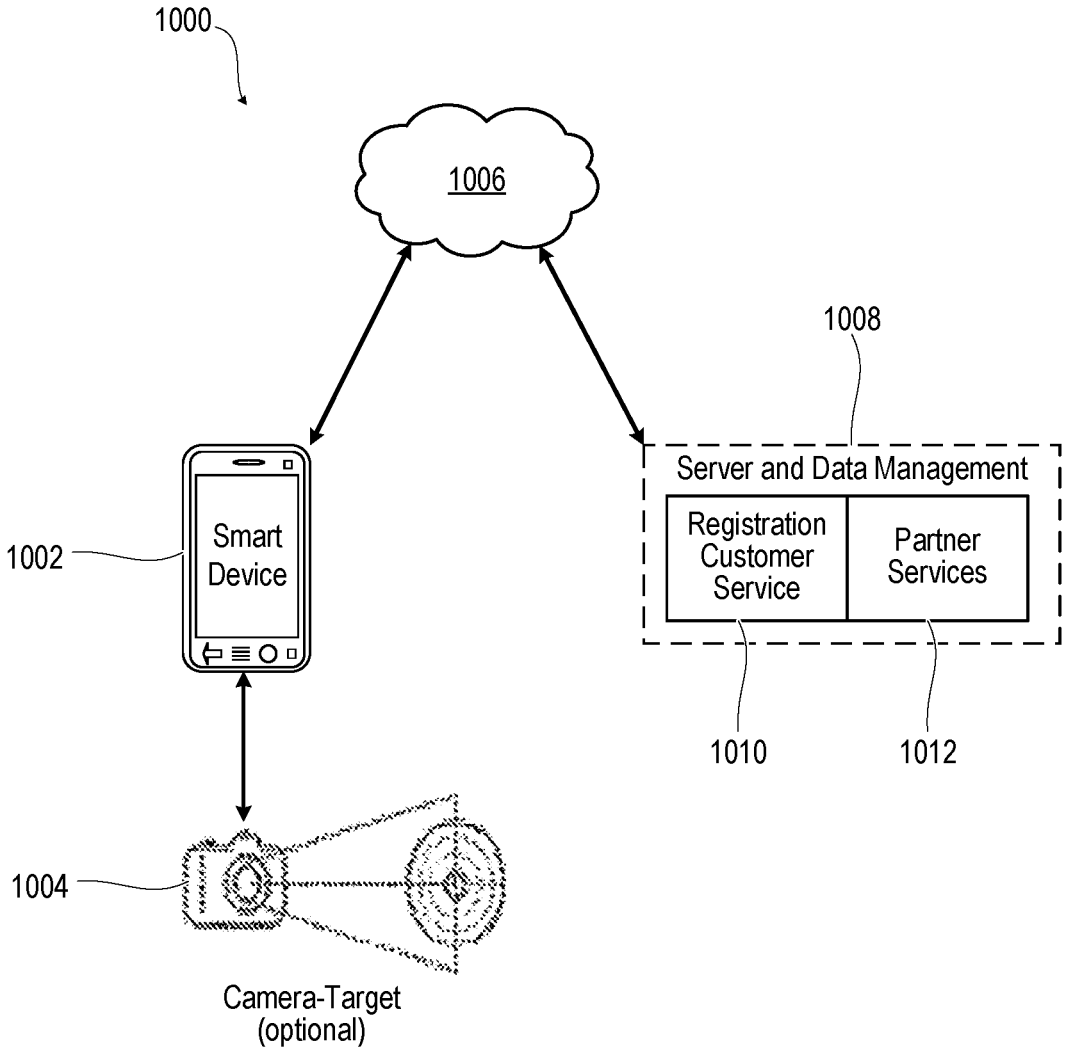
FIG. 10 is illustrative of a data collection environment of the present disclosure.

The present disclosure also provides for a system 1000. This ecosystem is illustrated by FIGS. 10-13. Turning first to FIG. 10, which illustrates on embodiment of the ecosystem, the system 1000 comprises an operator device 1002 configured to receive and transmit one or more data sets over a network 1006 and a server and data management module 1008 also configured to receive one or more data sets over a network. The service and data management module 1008 further comprises a registration customer service submodule 1010 and a partner services submodule 1012. The registration customer service submodule 1010 may be used to collect and transmit data from the operator and the partner services submodule 1012 may be used to collect and transmit data from one or more industry partners. In one embodiment the system 1000 further comprises a camera target 1004 configured to interact with the operator device 1002.

Figure 11:
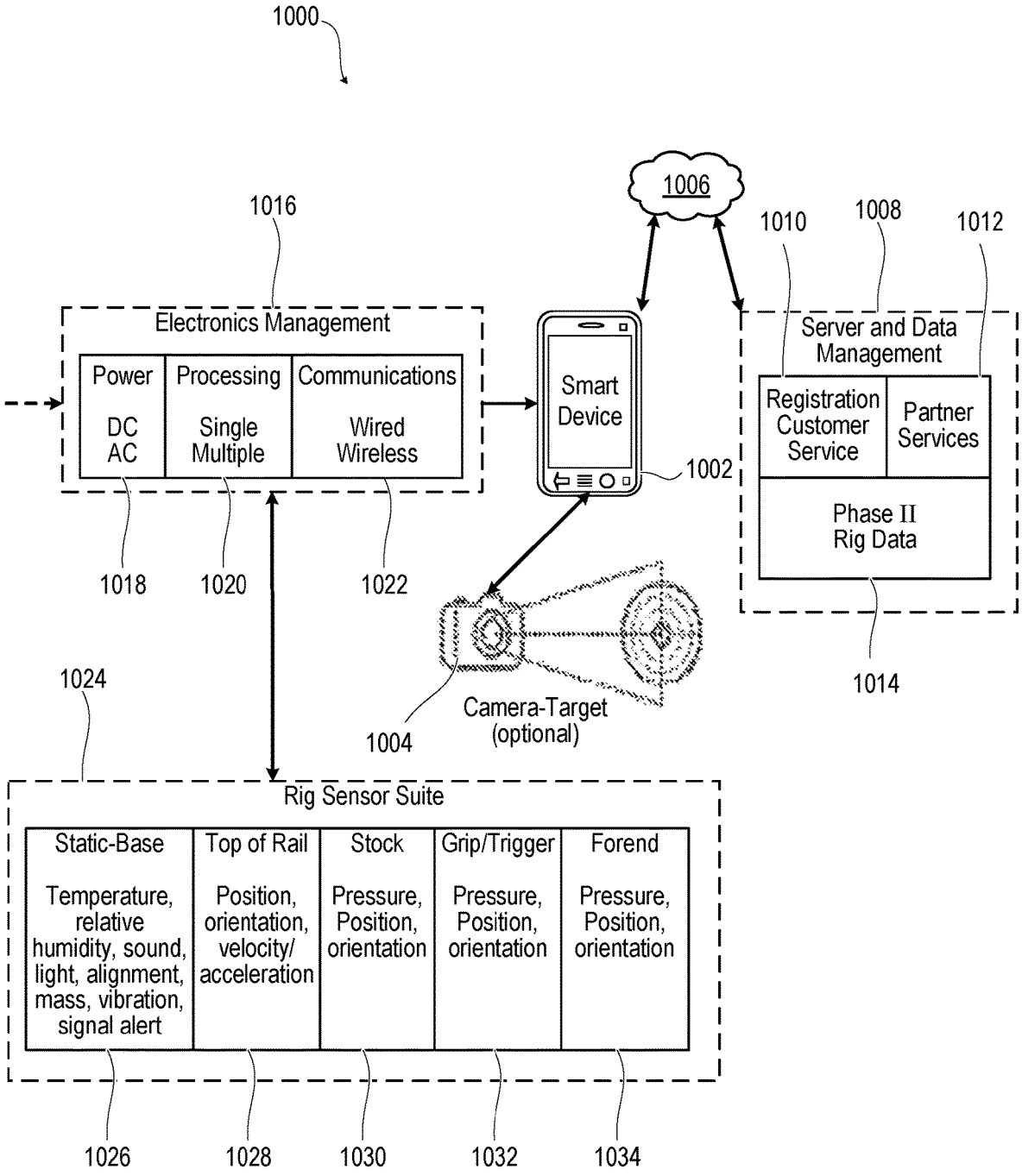
FIG. 11 is illustrative of a data collection environment of the present disclosure.

In another embodiment, illustrated by FIG. 11, the system 1000 further comprises an electronics management module 1016 which comprises a power source 1018, a processor 1020, and a communications submodule 1022. The system 1000 also comprises a rig sensor suite 1024 comprising a plurality of sensors affixed to at least one of an operator and a rig, where the rig sensor suite is operably coupled to the electronics management module 1016 and is configured to collect one or more data sets from at least one of the operator via the operator device 1002 and the rig. The rig sensor suite 1024 further comprises a plurality of different sensors including: (1) a -base sensor 1026 configured to receive one or more data sets associated with at least one of temperature, relative humidity, sound, light, alignment, mass vibration, signals, and alerts; (2) a top of rail sensor 1028 configured to receive one or more data sets associated with at least one of position, orientation, velocity, and acceleration; (3) a stock sensor 1030 configured to receive one or more data sets associated with at least one of pressure, position, and orientation; (4) a grip trigger sensor 1032 configured to receive one or more data sets associated with pressure, position, and orientation, and a forend sensor 1034 configured to receive one or more data sets associated with at least one of pressure, position, and orientation. In the embodiment of FIG. 11, the server and data management module 1008 may further comprise a rig data submodule 1014 configured to process one or more data sets received from the rig sensor suite.

Figure 12:
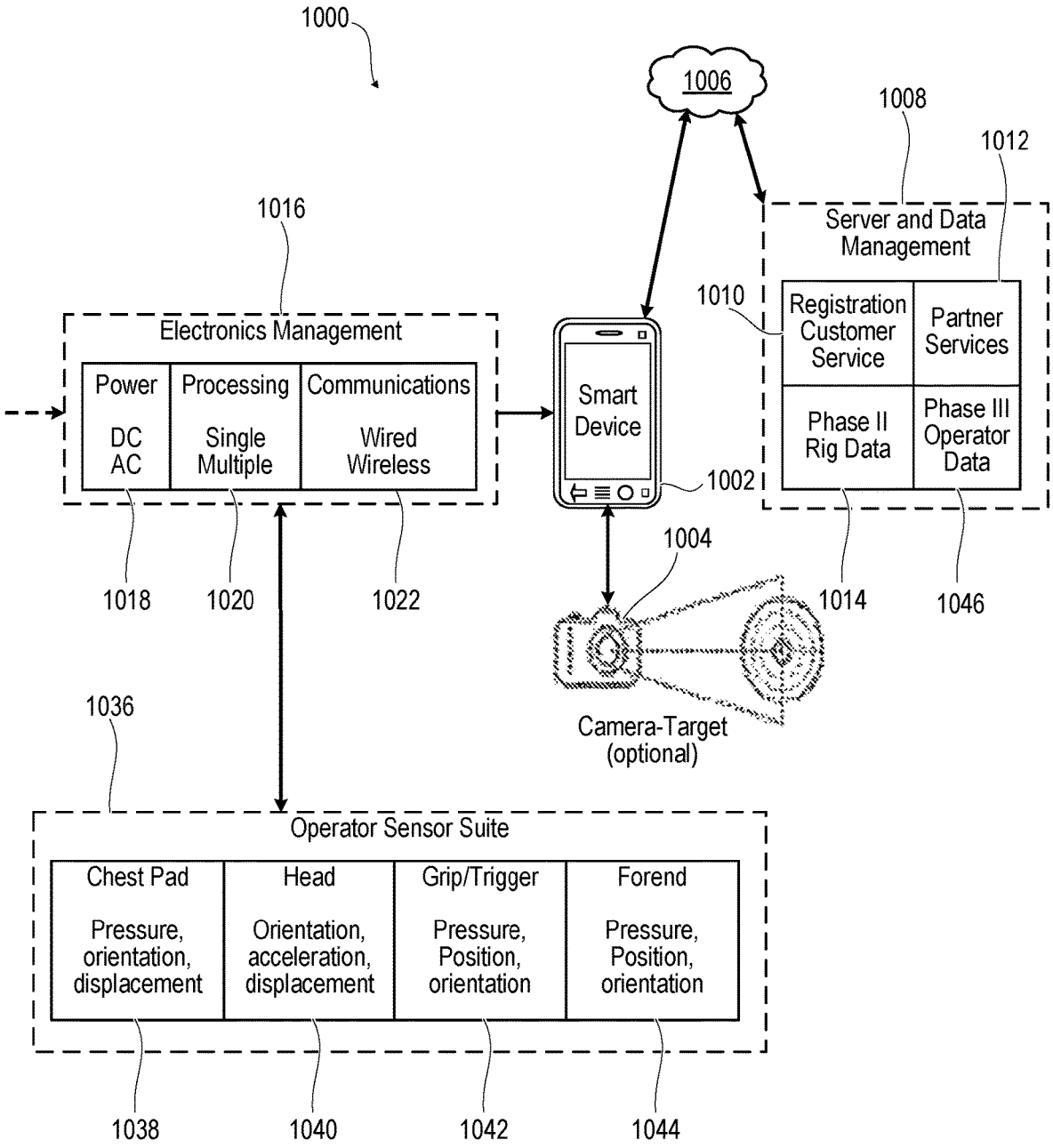
FIG. 12 is illustrative of a data collection environment of the present disclosure.

In another embodiment, illustrated by FIG. 12, the system 1000 further comprises an operator sensor suite 1036, where the operator sensor suite 1036 further comprises a plurality of different sensors including: (1) a chest pad sensor 1038 configured to receive one or more data sets associated with at least one of pressure, orientation, and displacement; (2) a head sensor 1040 configured to receive one or more data sets associated with at least one of orientation, acceleration and displacement; (3)*a* grip trigger sensor 1042 configured to receive one or more data sets associated with at least one of pressure, position, and orientation; and (4) a forend sensor 1044 configured to receive one or more data sets associated with at least one of pressure, position, and orientation.

Figure 13:
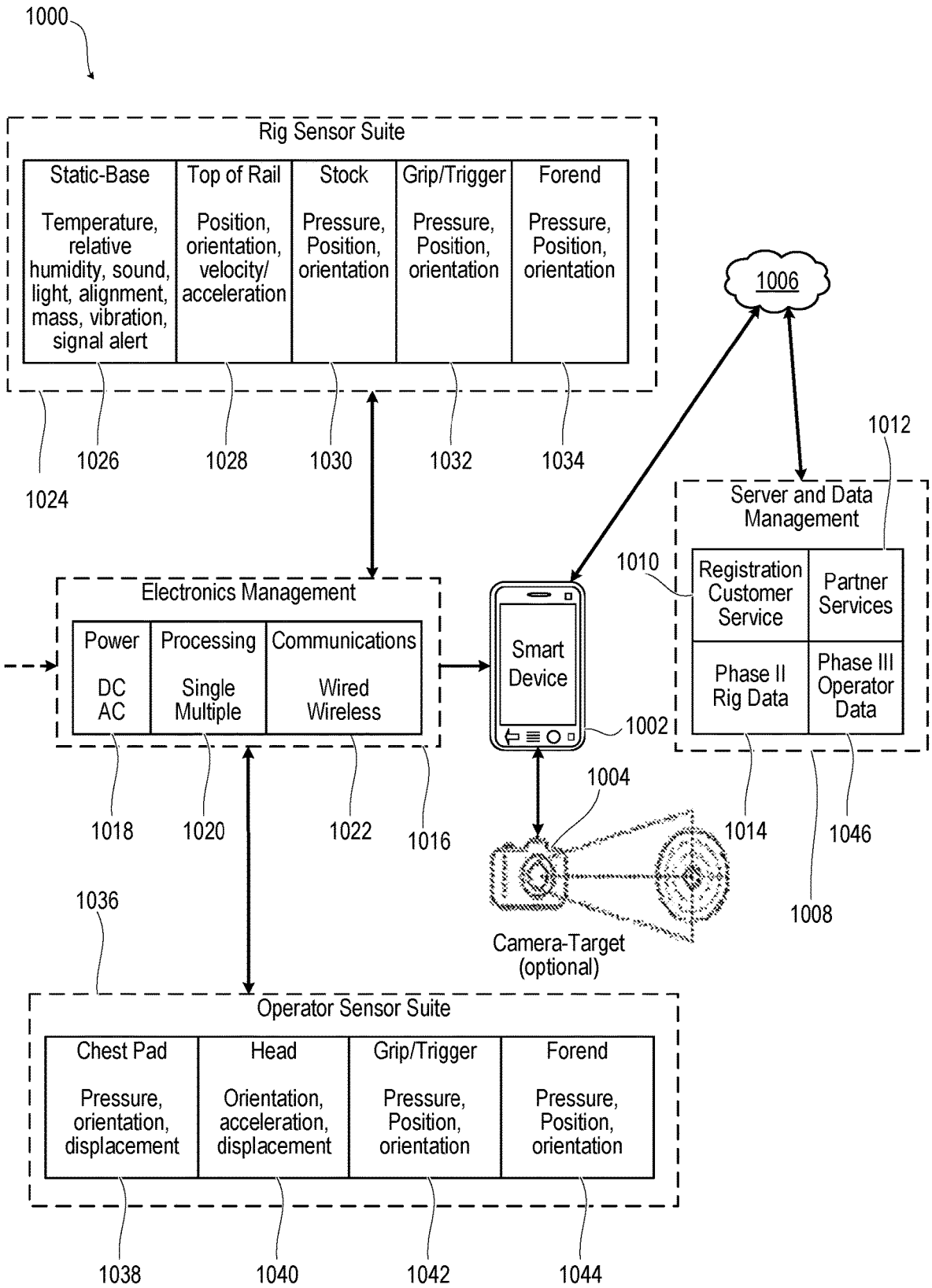
FIG. 13 is illustrative of a data collection environment of the present disclosure.

In another embodiment, illustrated by FIG. 13, the server and data management module 1008 further comprises an operator data submodule 1046 configured to process one or more data sets received from the operator device 1002. In yet another embodiment, the server and data management module 1008 further comprises comparative data submodule 1048 configured to process one or more data sets by applying an algorithm to compare the data sets to one or more baselines.

Figure 14:
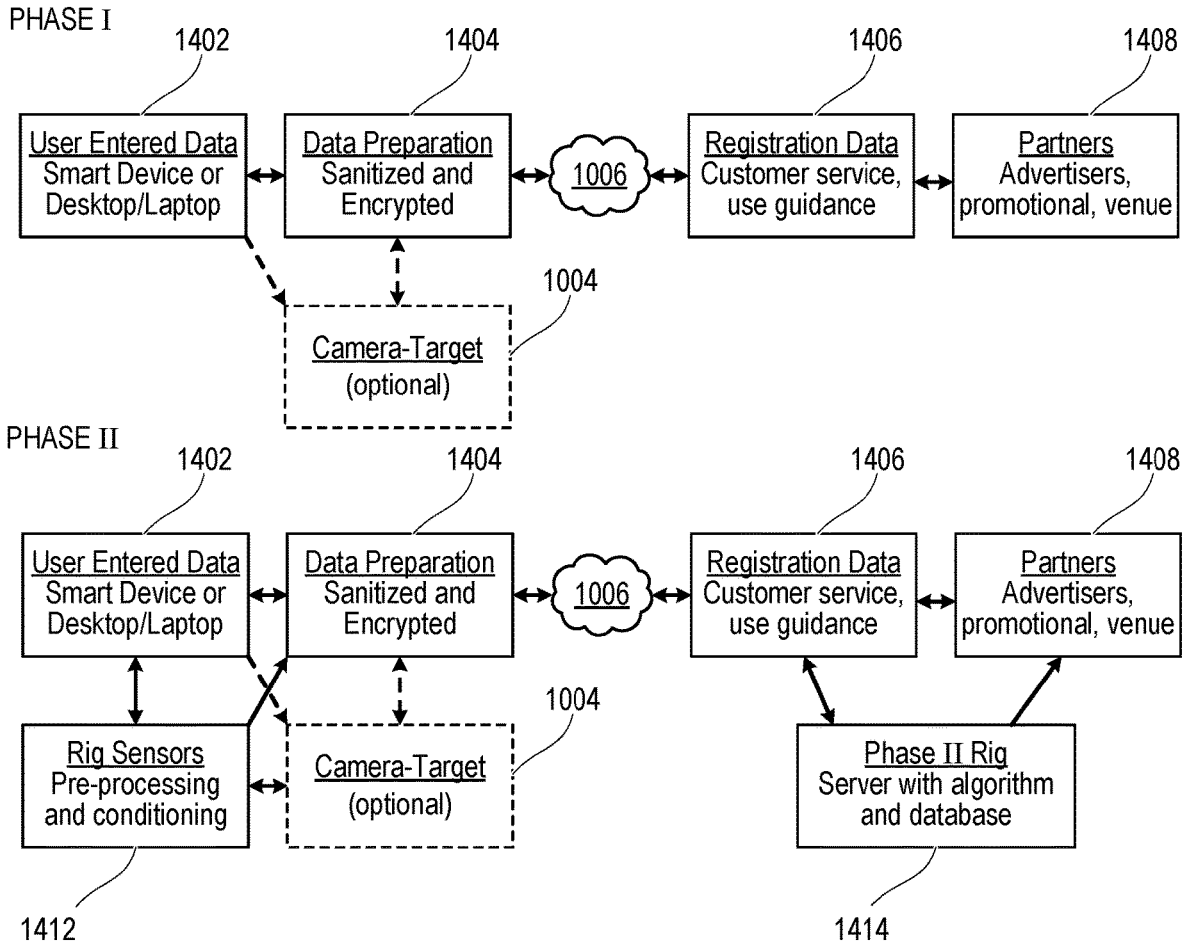
FIG. 14 illustrative of a data collection environment of the present disclosure.
Figure 15:
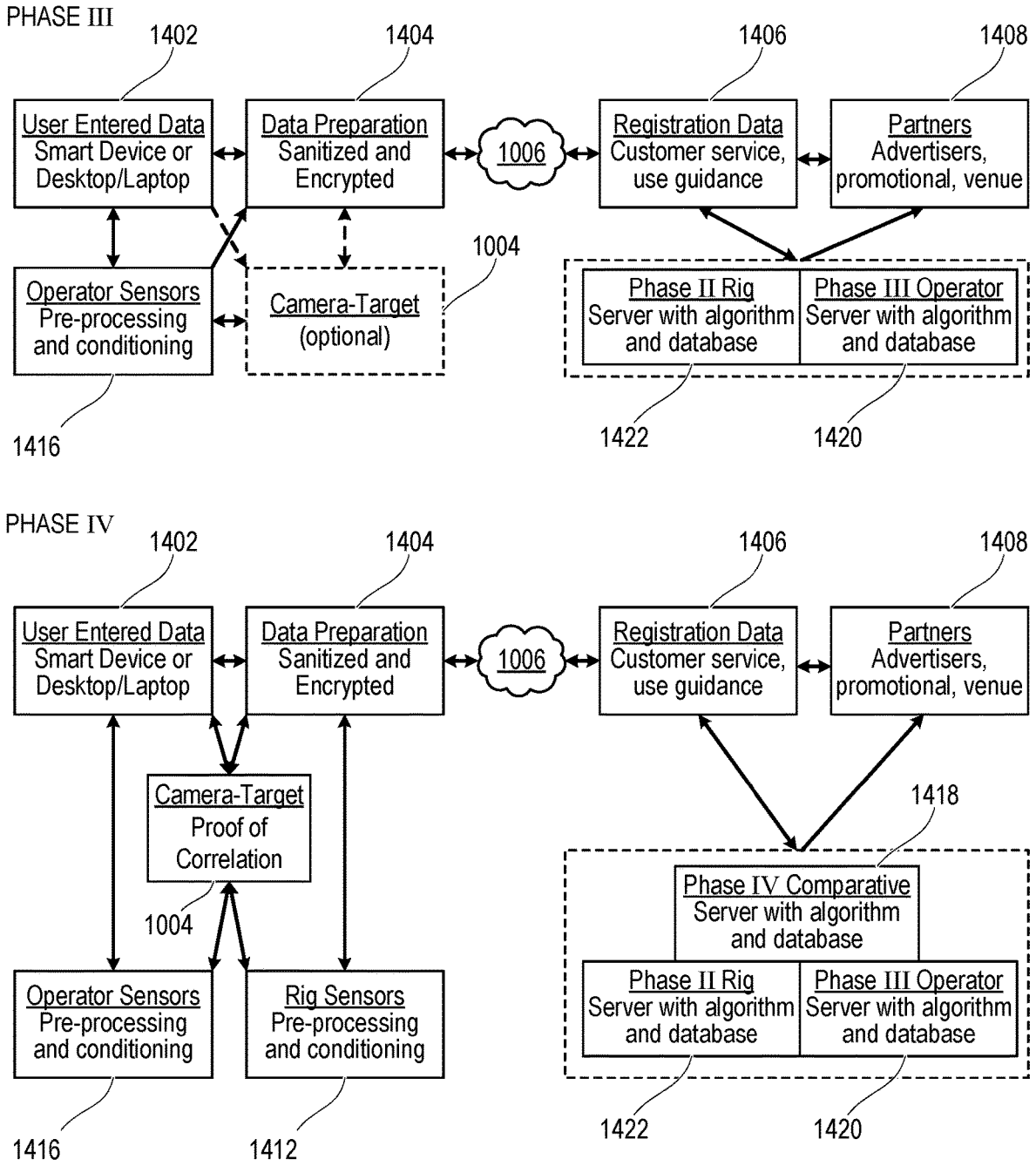
FIG. 15 is illustrative of a data collection environment of the present disclosure.

FIG. 14 and FIG. 15 are illustrative of a data collection environment of the present disclosure. An operator can enter data in step 1402 using an operator device. In one embodiment, the operator device may comprise a smart device or a computer such as a desktop or laptop. This operator data may be sanitized and encrypted at the data preparation step 1404. In one embodiment, data may also be collected and transmitted using a camera-target 1004, but such use is not required. Once the data is prepared at step 1404, the data is transmitted over a network 1006.

In alternative embodiments, additional data sets may be collected and transmitted using a plurality of rig sensors 1412 and operator sensors 1416. Registration data 1406, data collected from industry partners 1408, and data from a plurality of rig sensors may also be collected and transmitted via the network 1006 to the operator. Additional rig sensors 1422 and operator sensors 1420 may also be implemented on one embodiment. Comparative data 1418 may also be used in analyzing data obtained from an operator and/or a rig to determine thresholds and baselines relevant for providing performance feedback to the operator. There are a couple options for using comparison data: Assist operator to determine if they are performing better or worse relative to previous times; Assist operator to compare their performance to other operators using various categories such as demographic, firearm, distance, etc.

While the disclosure has been described in detail in reference to specific embodiments thereof, it will be apparent to one skilled in the art that various changes and modifications can be made therein without departing from the spirit and scope of the embodiments. Additionally, while the examples provided herein related to specific analytes, the present disclosure is not limited to these analytes and may be used to detect a wide variety of analytes of interest. Thus, it is intended that the present disclosure cover the modifications and variations of this disclosure provided they come within the scope of the appended claims and their equivalents.

What is claimed is:

1. A system comprising:

an operator device configured to receive and transmit one or more data sets over a network;

a server and data management module configured to receive and transmit one or more data sets over a network, where the server and data management module further comprises a registration customer service submodule and a partner services submodule;

a rig configured so as to hold a firearm in place at the same points as an operator;

a sensor suite comprising one or more sensors affixed to at least one of an operator and the rig;

an electronics management module operably connected with the operator device, where the electronics management module further comprises a power source, a processor/or processors, and a communications submodule; and a rig sensor suite where the rig sensor suite is operably coupled to the electronics management module and is configured to collect one or more data sets from at least one of the operator and the rig, where the rig sensor suite further comprises:

a base sensor configured to receive one or more data sets associated with at least one of temperature, relative humidity, sound, light, alignment, mass vibration, signals, and alerts;

a top of rail sensor configured to receive one or more data sets associated with at least one of position, orientation, velocity, and acceleration;

a stock sensor configured to receive one or more data sets associated with at least one of pressure, position, and orientation;

a grip trigger sensor configured to receive one or more data sets associated with pressure, position, and orientation, and a forend sensor configured to receive one or more data sets associated with at least one of pressure, position, and orientation; and where the server and data management module further comprises a rig data submodule configured to process one or more data sets received from the rig sensor suite.

2. The system of claim 1, further comprising a camera target.

3. The system of claim 1, where the server and data management module sensor suite further comprises a LASER for alignment and LIDAR for displacement measurements.

4. The system of claim 1, where the server and data management module further comprises comparative data submodule configured to process one or more data sets by applying an algorithm to compare the data sets to one or more baselines.

5. The system of claim 4, wherein the rig further comprises:

a base assembly comprising:

a longitudinal rail assembly;

a stock assembly operably connected to the longitudinal rail assembly and configured to support a stock of the firearm; and a grip/trigger assembly operably connected to the longitudinal rail assembly and configured to support a grip of the firearm and configured to enable remote operation of the system; and a forend assembly operably connected to the longitudinal rail assembly and configured to support a forend of the firearm.

6. The system of claim 5, wherein the base assembly further comprises a dog bone assembly and a plurality of swivel leveling mounts affixed to a plate of the dog bone assembly.

7. A system comprising:

an operator device configured to receive and transmit one or more data sets over a network;

a server and data management module configured to receive and transmit one or more data sets over a network, where the server and data management module further comprises a registration customer service submodule and a partner services submodule;

a rig configured so as to hold a firearm in place at the same points as an operator;

a sensor suite comprising one or more sensors affixed to at least one of an operator and the rig; and comprising:

a chest pad sensor configured to receive one or more data sets associated with at least one of pressure, orientation, and displacement;

a head sensor configured to receive one or more data sets associated with at least one of orientation, acceleration, and displacement;

a grip trigger sensor configured to receive one or more data sets associated with at least one of pressure, position, and orientation;

a forend sensor configured to receive one or more data sets associated with at least one of pressure, position, and orientation; and where the server and data management module further comprises an operator data submodule configured to process one or more data sets received from the operator sensor suite.

8. A system comprising:

an operator device configured to receive and transmit one or more data sets over a network;

a server and data management module configured to receive and transmit one or more data sets over a network, where the server and data management module further comprises: (i) a registration customer service submodule; (ii) a partner services submodule; and (iii) comparative data submodule configured to process one or more data sets by applying an algorithm to compare the data sets to one or more baselines;

a rig configured so as to hold a firearm in place at the same points as an operator;

a sensor suite comprising one or more sensors affixed to at least one of an operator and the rig, wherein:

the rig further comprises:

a base assembly comprising:

a longitudinal rail assembly;

a stock assembly operably connected to the longitudinal rail assembly and configured to support a stock of the firearm; and a grip/trigger assembly operably connected to the longitudinal rail assembly and configured to support a grip of the firearm and configured to enable remote operation of the system; and a forend assembly operably connected to the longitudinal rail assembly and configured to support a forend of the firearm;

the base assembly further comprises a dog bone assembly and a plurality of swivel leveling mounts affixed to a plate of the dog bone assembly; and the stock assembly further comprises:

a stock cradle, a brace, a first extension tube and a second extension tube, a plate configured to couple the first and second extension tubes, and a link base configured to connect the brace with the first and second extension tubes.

9. The system of claim 8, wherein the grip/trigger assembly further comprises:

an adjustable upright grip/trigger tower affixed to longitudinal rail assembly;

a trigger guard holding mechanism affixed to the adjustable upright grip/trigger tower;

a trigger guard gripper affixed to the adjustable upright grip/trigger tower; and a trigger engagement subassembly affixed to the longitudinal rail assembly configured to enable the trigger engagement mechanism when activated.

10. The system of claim 9, wherein the forend assembly further comprises an adjustable upright forend tower affixed to longitudinal rail assembly; and a forend cradle clamp mechanism affixed to the adjustable upright forend tower.

11. The system of claim 10, wherein the system further comprises a remote trigger assembly comprising:

trigger engagement subassembly which is operably connected to the longitudinal rail assembly, connected to, a remote pistol grip assembly configured to enable remote operation of the system comprises:

a remote pistol grip, a trigger handle, a pin, and a spring, coupled to a holder and a cable where the cable is further affixed to the pin;

a safety lanyard assembly comprising:

a lanyard, a pin operably connected to the lanyard via a cable to be inserted into the remote pistol grip assembly, and an anchor end, where the anchor end is operably coupled to the longitudinal rail assembly.

12. The system of claim 11, where the leveling mounts are each independently adjustable to adjust the height of at least a portion of the second.

13. The system of claim 11, where the safety lanyard assembly pin is configured to be inserted into the remote pistol grip to prevent unintended operation.

14. The system of claim 11, where the forend cradle clamp mechanism is adjustable to accommodate for the size and shape of the firearm.

15. The system of claim 11, wherein the one or more data sets are selected from the group consisting of system data, manufacturer data, operator data, user data, aggregated data and other external data input data.

* * * * *